US006095662A

United States Patent [19]

Burroughs et al.

[11] Patent Number: 6,095,662

[45] Date of Patent: Aug. 1, 2000

[54] LIGHTING FIXTURE WITH EMERGENCY ILLUMINATING DEVICE

[75] Inventors: Frederick C. Burroughs, Blacksburg; Stephen M. Stafford, Radford, both of Va.

[73] Assignee: Hubbell Incorporated, Orange, Conn.

[21] Appl. No.: 08/858,628

[22] Filed: May 19, 1997

[51] Int. Cl.[7] ..... F21V 3/00; F21V 17/06

[52] U.S. Cl. ..... 362/235; 362/439; 362/440

[58] Field of Search ..... 362/20, 21, 223, 362/224, 228, 235, 236, 240, 255, 437, 439, 440, 444, 445, 249, 247

[56] References Cited

U.S. PATENT DOCUMENTS

| | | | |
|---|---|---|---|
| 988,971 | 7/1911 | Legge et al. | 362/440 |
| 1,081,756 | 12/1913 | Krohn | 362/437 |
| 1,763,889 | 6/1930 | Hudson | 362/440 |
| 2,056,659 | 10/1936 | Fenwick et al. | 362/228 |
| 3,336,473 | 8/1967 | Buzan | 362/20 |
| 4,504,894 | 3/1985 | Reibling | 362/20 |

OTHER PUBLICATIONS

*Buyers Guide,* Hubbell Lighting, Inc., pp. 160–163, 1994.

*Scientific Products General Catalog, Products for Diagnostics, Industry and Science,* Baxter; pp. 1879; 1991–1992.

Killark® Electrical Construction Products, Catalog 9400, pp. 19–23; 1994.

Installation Instructions for TRIBAY Series Reflector Section Assembly CONTROLUX 2.0, Hubbell Lighting, Inc. Instruction Sheet, No. 268–0905–9901, One Sheet, Figs. 1–3; published prior to May 1997.

Installation Instructions for TRIBAY Series Reflector Section Assembly SUPERWATT 2.0, Hubbell Lighting, Inc. Instruction Sheet, No. 268–0906–9901, one sheet, Figs. 1–2; published prior to May 1997.

Installation Instructions for TRIBAY Series Reflector Section Assembly SUPERBAY 2.0, Hubbell Lighting, Inc. Instruction Sheet, No. 268–0907–9901, two sheets, Figs. 1–4; published prior to May 1997.

Installation Instructions for Reflector Section Assembly Hubbell Lighting, Inc. Instruction Sheet, No. 268–1012–9901, one sheet, Figs. 2–5; published prior to May 1997.

*Primary Examiner*—Alan Cariaso

*Attorney, Agent, or Firm*—Jerry M. Presson; Stacey J. Longanecker; Thomas P. Hilliard

[57] ABSTRACT

A lighting fixture with emergency illuminating device having a housing, first and second electrical sockets, first and second lamps, and a first translucent cover. The housing having electrical wiring for connection to a power source. The first electrical socket coupled to the housing and electrically coupled to the wiring, and having a first central axis and a first width transverse to the first central axis. The second electrical socket coupled to the housing and electrically coupled to the wiring, and having a second central axis and a second width transverse to the second central axis that is greater than the first width of the first electrical socket. The first lamp having a connecting end removably coupled within the first electrical socket and a translucent bulb portion extending from the connecting end. The second lamp having a connecting end removably coupled within the second electrical socket and a translucent bulb portion extending from the connecting end of the second lamp. The first lamp located within the first cover and the second lamp located outside the first cover.

25 Claims, 7 Drawing Sheets

FIG. 5
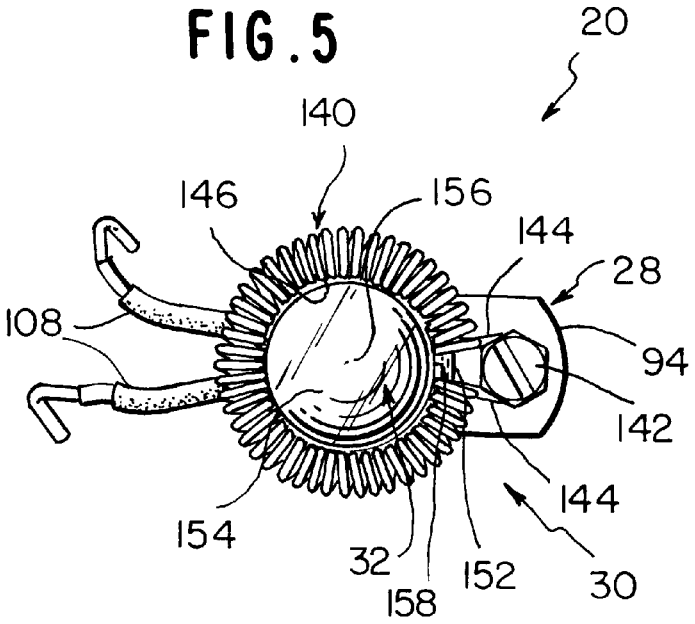
FIG. 6
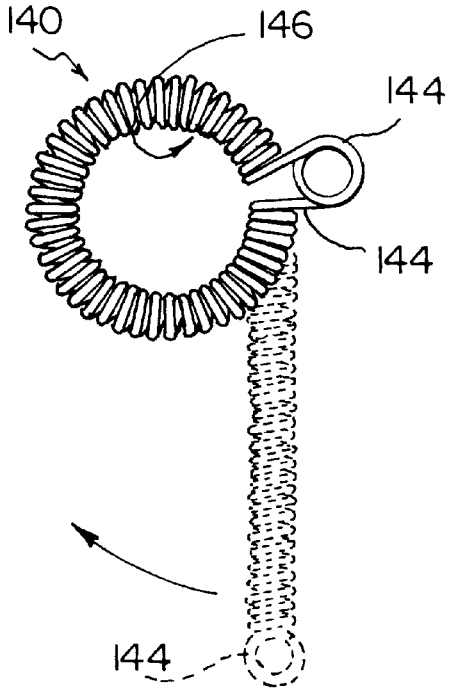
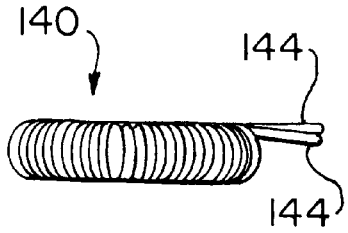
FIG. 7

FIG.8
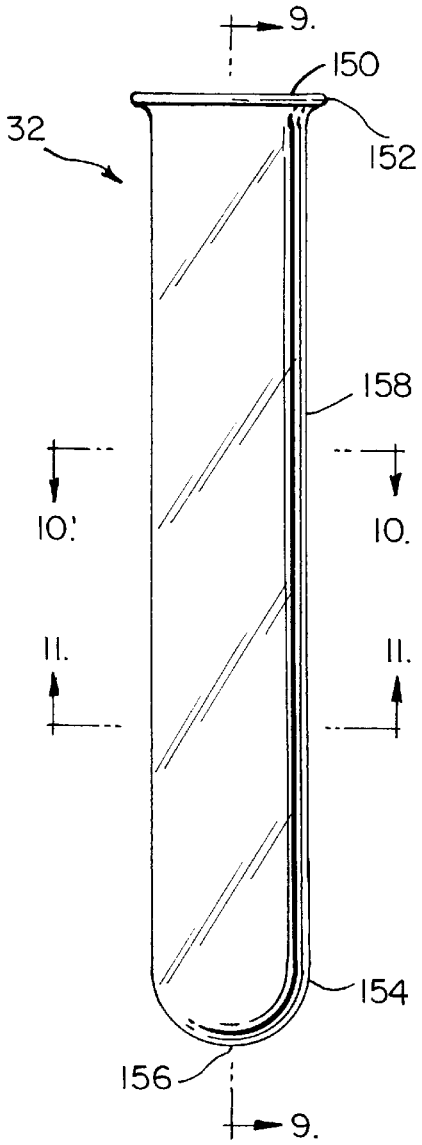
FIG.9
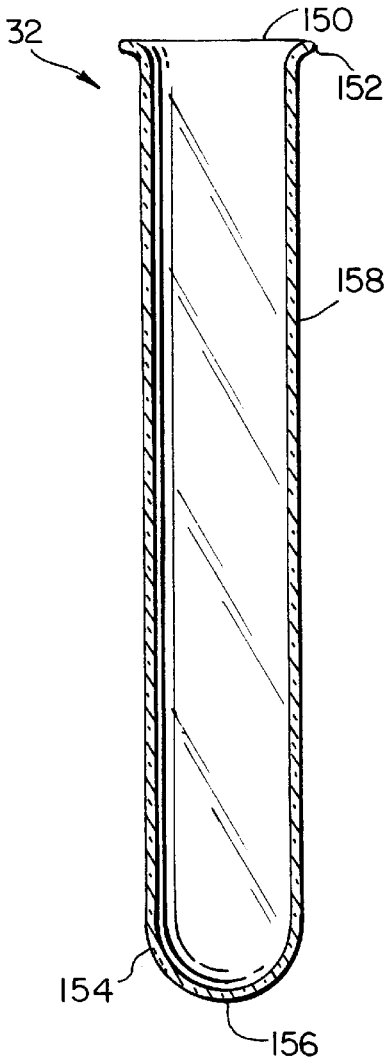
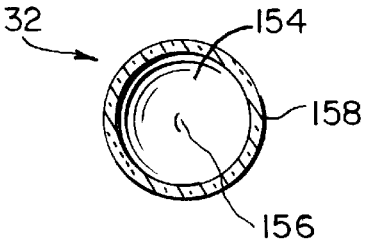
FIG.10
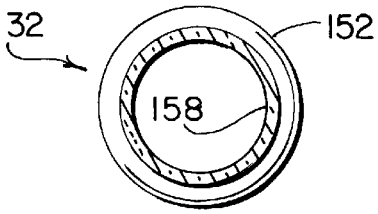
FIG.11

LIGHTING FIXTURE WITH EMERGENCY ILLUMINATING DEVICE

FIELD OF THE INVENTION

This present invention generally relates to a lighting fixture with a backup or emergency illuminating device. More specifically, this invention relates to a backup or illuminating device with a confinement system for preventing glass particles from falling when the bulb of the illuminating device inadvertently explodes.

BACKGROUND OF THE INVENTION

High-intensity discharge ("HID") lamps are commonly used to provide illumination over large areas. For instance, HID lamps are frequently used in industrial plants, warehouses, and aircraft hangers. However, one drawback to HID lamps is that they can require up to ten minutes to restrike after being turned off. This drawback becomes especially problematic when the voltage to illuminated HID lamps momentarily stops or dips and causes the HID lamps to extinguish. Individuals relying upon the HID lamps for light must then wait for up to ten minutes for the HID lamps to restrike.

In order to avoid these temporary blackouts and to provide illumination after the HID lamps have extinguished and before they restrike, it is common to provide auxiliary, emergency lighting with some HID lamps. These emergency lamps are commonly quartz lamps. However, quartz lamps run extremely hot with surface temperatures exceeding 600° C. Further, if a substance such as grease is accidentally smudged on the quartz envelope, the temperature of the quartz lamp increases even higher. This increase in temperature can cause the quartz lamp to inadvertently explode. Also, quartz lamps are known to explode simply due to age.

When a quartz emergency lamp explodes, hot glass particles and fragments are released and fall to the floor below if not confined within the lighting fixture. These glass particles can be dangerous to any individuals or equipment located beneath the HID lamps. Even if a quartz lamp is enclosed by the lighting fixture, the explosion scatters particles throughout the fixture. This makes the replacement of the quartz lamp dangerous, and the clean-up of the fixture more difficult.

In view of the above, it is apparent that there exists a need for a confinement system for a quartz emergency lamp which will neatly contain the particles from the lamp if the lamp inadvertently explodes. This invention addresses this need in the art, along with other needs, which will become apparent to those skilled in the art once given this disclosure.

SUMMARY OF THE INVENTION

Accordingly, an object of the present invention is to provide a protective cover for an auxiliary, emergency lamp.

Another object of the present invention is to provide a cover for an emergency lamp that is easy to remove and reinstall.

Still another object of the invention is to provide a cover for a quartz emergency lamp for containing hot glass particles and fragments released upon inadvertent explosion of the lamp.

A further object of the invention is to provide a cover for a quartz emergency lamp that is easily removed for neatly disposing of glass particles and fragments resulting from an inadvertent explosion of the lamp.

The foregoing objects are basically attained by providing a lighting fixture with an emergency illuminating device, comprising a housing with electrical wiring for connection to a power source; a first electrical socket coupled to the housing and electrically coupled to the wiring, and having a first central axis and a first width transverse to the first central axis; a second electrical socket coupled to the housing and electrically coupled to the wiring, and having a second central axis and a second width transverse to the second central axis that is greater than the first width; a first lamp having a connecting end removably coupled within the first electrical socket and a translucent bulb portion extending from the connecting end; a second lamp having a connecting end removably coupled within the second electrical socket and a translucent bulb portion extending from the connecting end of the second lamp; and a first translucent cover, with the first lamp located within the first cover and the second lamp located outside the first cover.

The foregoing objects are further attained by providing an illuminating device, comprising an electrical socket having an open end; a mounting member coupled to the electrical socket; a lamp having a connecting end removably received within the open end of the electrical socket and a translucent bulb portion extending from the connecting end; a translucent cover surrounding the bulb portion of the lamp; and a fastening member coupled to the mounting member and having an elastic element, and the light bulb cover being removably attached to the socket by the elastic element.

The foregoing objects are still further attained by providing an illuminating device, comprising an electrical socket having an open end; a mounting member coupled to the electrical socket; a lamp having a connecting end removably received within the open end of the electrical socket and a translucent bulb portion extending from the connecting end, the bulb portion having a base coupled to the connecting end and a free end with an outermost point, and the lamp extending a first length from the connecting end to the outermost point; a translucent cover coupled to the electrical socket and surrounding the bulb portion, and having an open end portion with an outwardly extending flange portion positioned adjacent thereto, a closed end portion with an outermost point spaced from the open end portion and a hollow tubular portion extending between the open end portion and the closed end portion, the cover extending a second length from the open end portion to the outermost point and the second length being at least approximately twice as long as the first length; and a fastening member coupled to the mounting member for removably attaching the cover to the socket.

Other objects, advantages and salient features of the invention will become apparent to those skilled in the art from the following detailed description which, taken in conjunction with the annexed drawings, discloses preferred embodiments of the invention.

BRIEF DESCRIPTION OF THE DRAWINGS

Referring now to the attached drawings which form a part of this original disclosure:

FIG. 5 is a bottom view of the emergency illuminating device shown in FIGS. 1, 3 and 4 in accordance with the present invention, as viewed along the longitudinal axis of the lamp of the emergency illuminating device;

FIG. 6 is a bottom elevational view of the retaining spring for the emergency illuminating device illustrated in FIGS. 1 and 3–5 in accordance with the present invention and in its installed configuration with the original configuration of the retaining spring being illustrated in phantom lines;

FIG. 7 is a side elevational view of the retaining spring illustrated in FIG. 6 in accordance with the present invention and in its installed configuration;

FIG. 8 is a side elevational view of the emergency lamp cover as illustrated in FIGS. 1 and 3–5 in accordance with the present invention;

FIG. 9 is a longitudinal cross-sectional view of the emergency lamp cover for the emergency illuminating device illustrated in FIGS. 1 and 3–5, taken along section line 9—9 of FIG. 8;

FIG. 10 is a transverse cross-sectional view of the emergency lamp cover for the emergency illuminating device in FIGS. 1 and 3–5, taken along section line 10—10 of FIG. 8;

FIG. 11 is a transverse cross-sectional view of the emergency lamp cover for the emergency illuminating device in FIGS. 1 and 3–5, taken along section line 11—11 of FIG. 8.

DETAILED DESCRIPTION OF THE INVENTION

Figure 1:
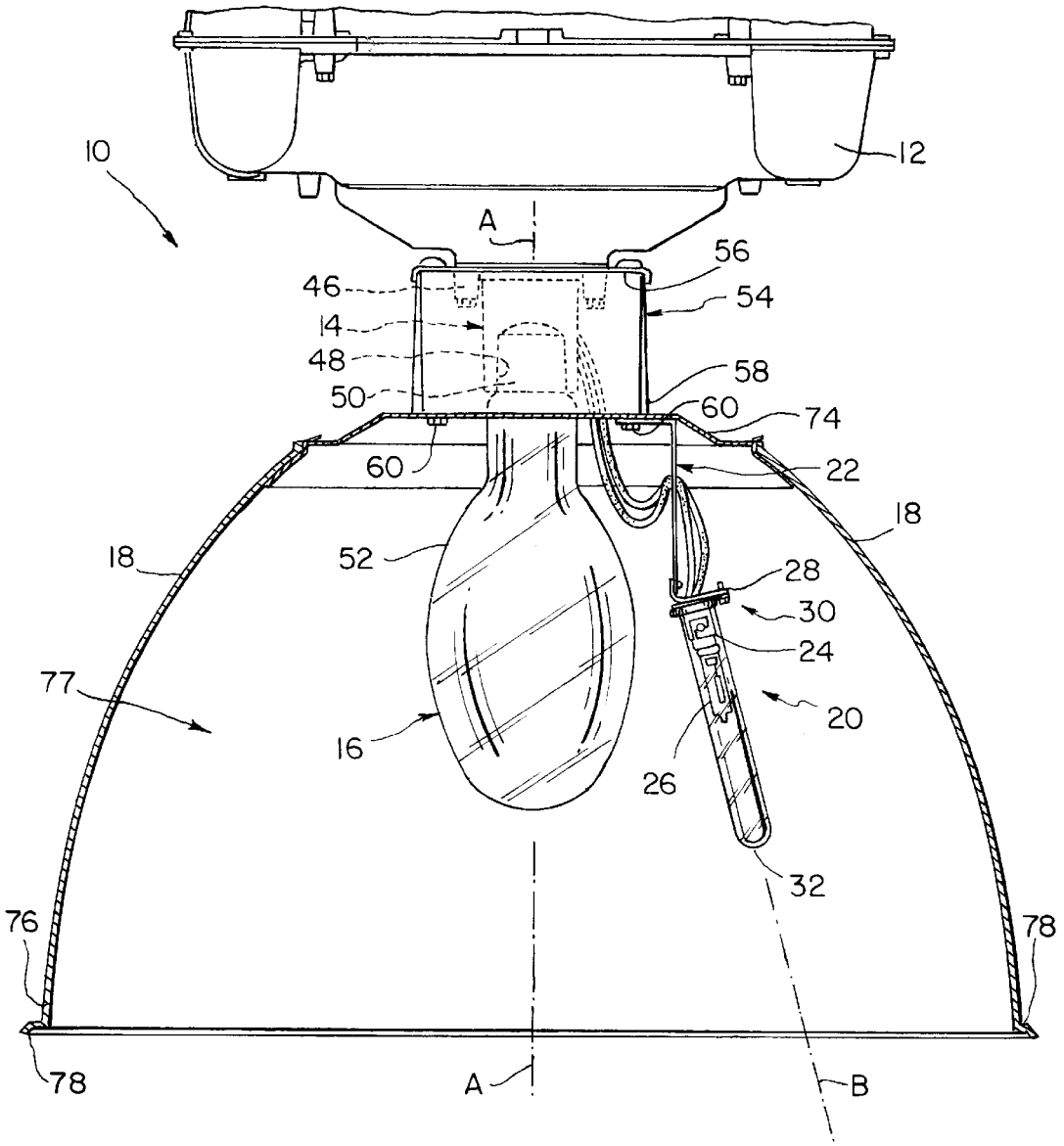
FIG. 1 is a partial, side elevational view of a lighting fixture with emergency illuminating device in accordance with the present invention illustrating a partial view of the housing and a sectional view of the reflector.

Referring initially to FIG. 1, a lighting fixture 10 in accordance with the present invention is illustrated. Lighting fixture 10 includes a ballast housing 12, a main electrical socket 14, a main lamp 16, a reflector 18 and an emergency illuminating device 20. Emergency illuminating device 20 has a mounting bracket 22, an auxiliary electrical socket 24, an emergency lamp 26, a mounting member 28, a fastening member 30 and an emergency lamp cover 32.

Figure 2:
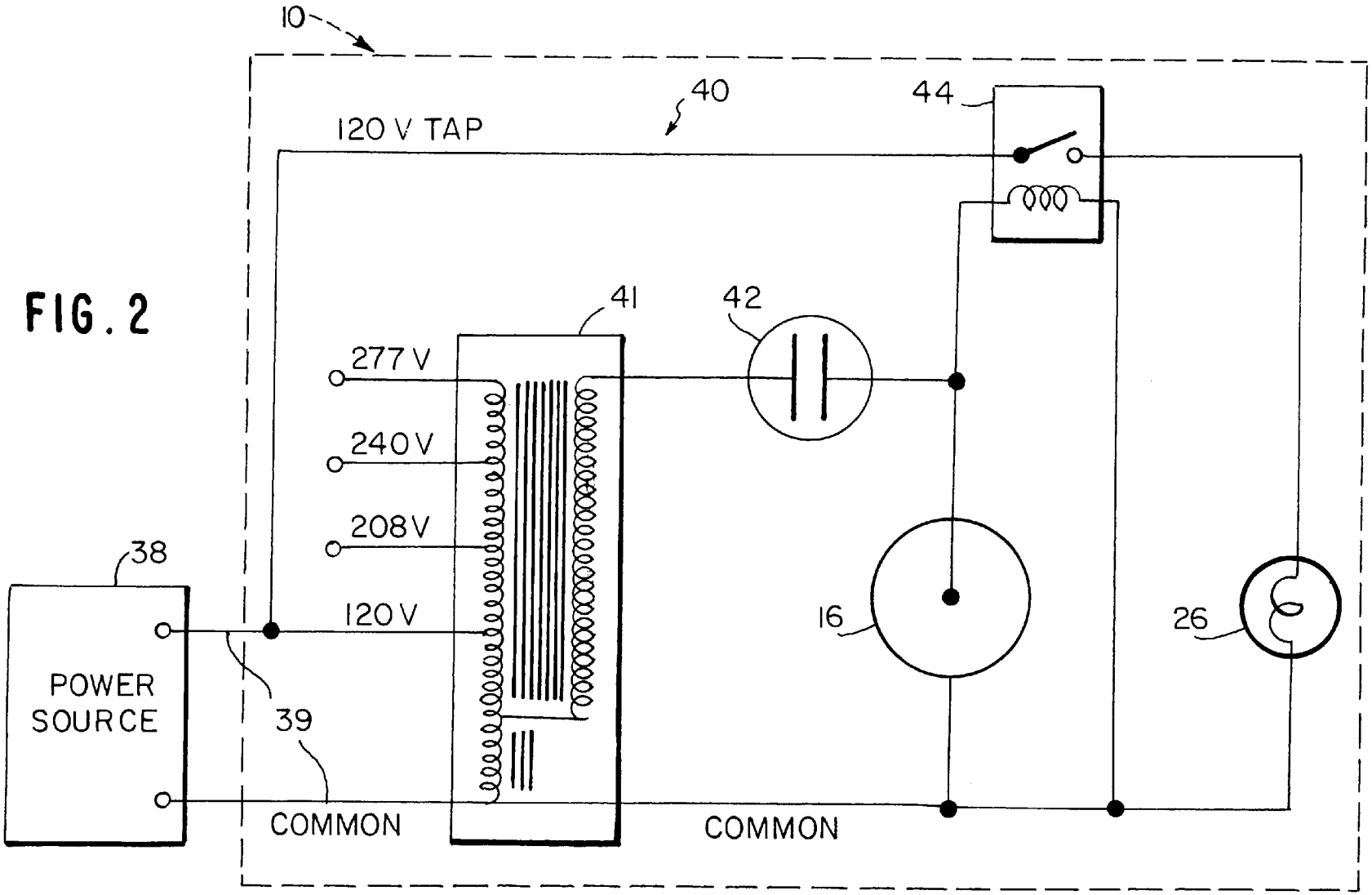
FIG. 2 is a schematic circuit diagram for the lighting fixture with emergency illuminating device in accordance with the present invention illustrated in FIG. 1.

Lighting fixture 10 with emergency illuminating device 20 is electrically coupled to a power source 38 as schematically illustrated in FIG. 2. In particular, lamps 16 and 26 are controlled by a circuit 40 as schematically illustrated in FIG. 2. Using appropriate, conventional wiring 39, circuit 40 electrically connects the ballast 41 within ballast housing 12, main lamp 16 and emergency lamp 26 together with a capacitor 42 and a relay 44. Circuit 40 is constructed so that under normal operating conditions, i.e., when main lamp 16 is "on" and giving off full illumination, emergency lamp 26 is "off." However, if the voltage to main lamp 16 is temporarily cut off or lowered causing main lamp 16 to extinguish, relay 44 automatically switches emergency lamp 26 "on" to provide auxiliary lighting during the period before main lamp 16 restrikes. Once main lamp 16 restrikes, relay 44 automatically switches emergency lamp 26 "off" to resume normal operating conditions.

Circuit 40 is a schematic of a basic circuit for a lighting fixture 10 employing a metal halide main lamp 16 and a quartz emergency lamp 26. Circuit 40 can vary slightly for other types of lighting fixtures employing other types of lamps. For instance, it will be apparent to those skilled in the art from this disclosure that circuit 40 can be modified to accommodate lamps other than a metal halide lamp, such as a high pressure sodium lamp. Accordingly, it will be apparent to those skilled in the art that other types of lamps as well as circuits can be used to implement the present invention. Main lamp 16 and emergency lamp 26 which are discussed in greater detail below are being used to illustrate one embodiment.

Referring to the first embodiment of the invention illustrated in FIG. 1, ballast housing 12 is a two-piece member which is rigidly attached at one end to a rigid supporting structure (not shown) in a conventional manner and is rigidly attached at its lower end or bottom 46 to main electrical socket 14, as well as to reflector 18 and emergency illuminating device 20. Housing 12 encloses ballast 41 which is electrically connected to a power source 38 by conventional electrical wiring 39. The construction and function of ballast 41 and ballast housing 12 are conventional, and well-known in the art. Thus, ballast 41 and ballast housing 12 will not be discussed in detail herein. Preferably, housing 12 is formed as two-pieces that are made from die-cast aluminum with a corrosion resistant finish, and is mounted to the rigid support structure using a conventional mounting system (not shown).

Main electrical socket 14 is rigidly coupled to housing 12 by appropriate fasteners in a conventional manner and is electrically connected to housing 12 via conventional electrical wiring 39 as schematically shown in FIG. 2. As seen in FIG. 1, main socket 14 is a conventional lamp socket that has a threaded inner aperture 48 to threadedly receive main lamp 16 in a conventional manner. Main socket 14 also has a central axis A and a width that extends perpendicular to central axis A.

In this embodiment of the present invention, main lamp 16 is a conventional HID lamp having a connecting end 50 and a bulb portion 52. Main lamp 16 is preferably a 70–400 watt high pressure sodium or metal halide lamp, although other types of lamps may be used. Since main lamp 16 is a conventional lamp, main lamp 16 will only be briefly discussed herein. Connecting end 50 of main lamp 16 is threaded and capable of being removably coupled within main socket 14 in a conventional manner. Bulb portion 52 of main lamp 16 extends longitudinally from connecting end 50 and is a translucent glass envelope.

It should be understood, that the word "translucent" as it is used to describe materials in this disclosure is defined as permitting the passage of light through the material. Therefore, the word translucent as used herein, encompasses materials that permit light to pass therethrough, including but not limited to materials that diffuse the light so that objects on the other side cannot be clearly distinguished, i.e., partially transparent, as well as materials that permit light to pass therethrough so that objects on the other side may be distinctly seen, i.e., transparent.

Main socket 14 is surrounded by a conventional, cylindrical enclosure 54 which is connected to bottom 46 of housing 12. Enclosure 54 is preferably metallic and has an upper end 56 that is rigidly coupled to bottom 46 in a conventional manner and a lower end 58 that receives reflector mounting screws 60 in a conventional manner.

Reflector 18 is connected to housing 12 via enclosure 54 and has an upper end 74 and an open end 76 that is spaced from upper end 74. Upper end 74 is rigidly coupled to enclosure 54 by reflector mounting screws 60. Open end 76 permits direct access to the elements within reflector 18, and unobstructed illumination from main lamp 16 and emergency lamp 26. Reflector 18 is generally semi-spherical and forms a hollow cavity 77 in which main lamp 16 and emergency lamp 26 are located. Thus, reflector 18 extends 360° around main lamp 16 in planes substantially perpendicular to central axis A of main socket 14.

Central axis A of main lamp 16 is also the central axis of reflector 18. The term "reflector" as used in this disclosure is intended to encompass not only elements that reflect light, but also elements that refract light. Therefore, the term "reflector" as used herein is intended to encompass both reflectors and refractors. Reflector 18 is preferably made from high purity, heavy gauge aluminum having a rolled edge 78 at open end 76 for added strength. Alternatively, reflector 18 can be made from a plastic material or the like such as acrylic. Reflector 18 can be opaque or translucent as needed and/or desired. Thus, reflector 18 can refract light, if needed and/or desired.

Although reflector 18 is illustrated in FIG. 1 as having open end 76 uncovered, alternatively, reflector 18 can be fitted with a separate, translucent refractor or lens (not shown) to enclose cavity 77 within reflector 18. Closing open end 76 prevents entry of contaminants which could reduce the illuminating efficiency of main lamp 16 by adhering to main lamp 16 or reflector 18. Such lenses are conventional, and are preferably substantially planar and connected to reflector 18 around rolled edge 78. Ideally, a gasket (not shown) is interposed between the lens and rolled edge 78. The lenses are commonly hinged and latched to rolled edge 78 for easy entry into cavity 77 and easy access to main lamp 16. Generally, the lens is made of glass or plastic and is heat and impact resistant.

It should be understood that reflector 18 as illustrated in FIG. 1 and described herein is merely one example of one type of reflector that can be used in lighting fixture 10. Any appropriate reflector shape or configuration may be employed depending upon the desired location of lighting fixture 10 and its intended purpose. Likewise, the elements of lighting fixture 10 used in conjunction with emergency illuminating device 20 merely represent one of many specific lighting fixtures in which emergency illuminating device 20 may be employed.

As seen in FIGS. 1 and 3–5, mounting bracket 22 is generally L-shaped with an upper coupling end or portion 84 and an elongated lower coupling end or portion 86 extending substantially perpendicular to upper coupling end 84. Mounting bracket 22 is generally rigid and made from any appropriate material of sufficient strength to rigidly support the other elements of emergency illuminating device 20. Preferably, mounting bracket 22 is constructed from a metallic sheet material. Upper coupling end 84 has a coupling aperture 88 for fixedly coupling emergency illuminating device 20 to enclosure 54. Lower coupling end 86 has a coupling aperture 90 for fixedly coupling auxiliary electrical socket 24 thereto via mounting member 28. Each of coupling ends 84 and 86 are thin, substantially rectangular, planar portions.

Upper coupling end 84 of mounting bracket 22 is preferably removably attached to enclosure 54 by one of the reflector mounting screws 60 which is received within coupling aperture 88 and then fastened to enclosure 54. After reflector mounting screw 60 is tightened into position, mounting bracket 22 is rigidly coupled to reflector 18, enclosure 54 and housing 12. Furthermore, mounting bracket 22 is positioned such that upper coupling end 84 extends longitudinally away from main lamp 16. In other words, upper coupling end 84 is positioned between lower coupling end 86 and central axis A of main socket 14.

Lower coupling end 86 is sufficiently shaped and/or angled to position emergency lamp 26 away from upper end 74 of reflector 18 and towards open end 76 so that the illuminating ability of emergency lamp 26 can be better optimized.

Figure 3:
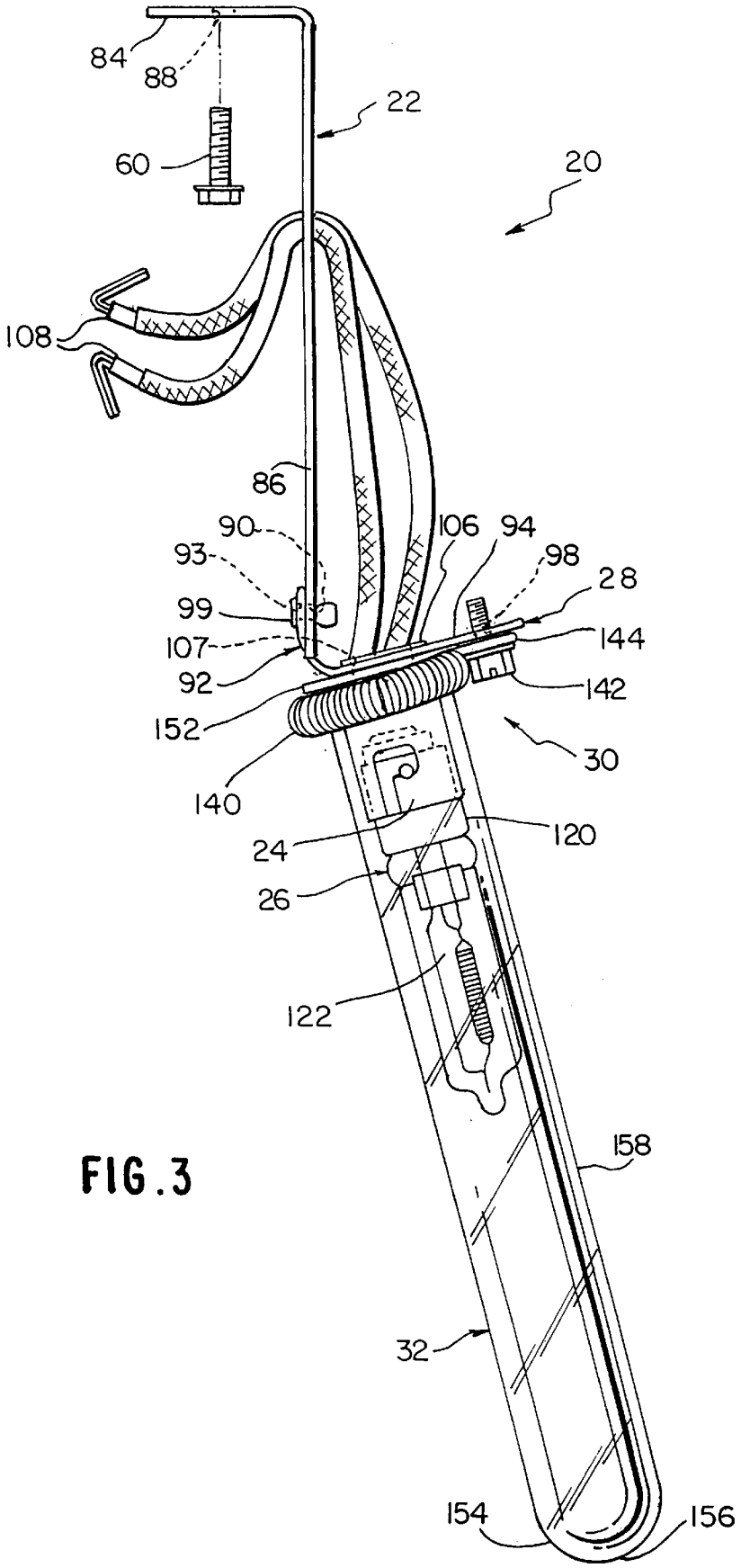
FIG. 3 is an enlarged, side elevational view of the emergency illuminating device illustrated in FIG. 1 in accordance with the present invention.
Figure 4:
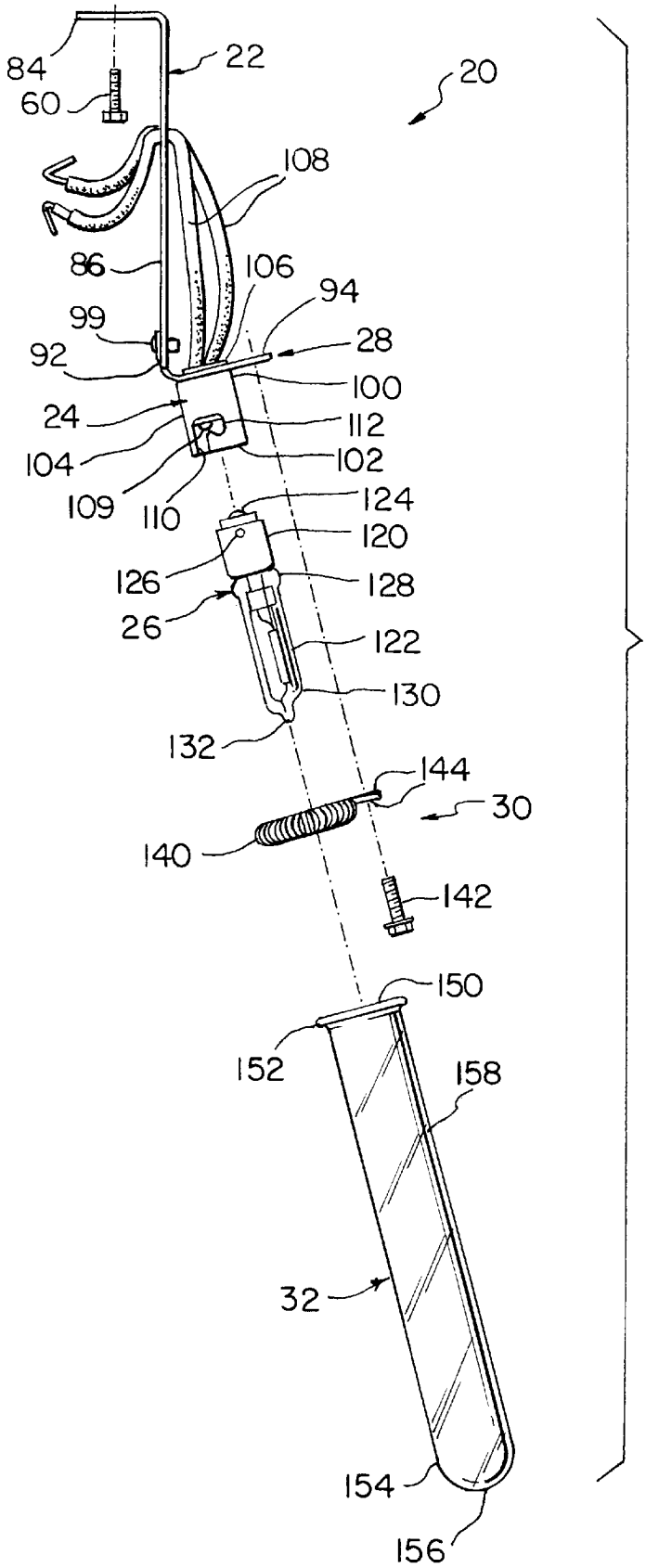
FIG. 4 is an exploded, side elevational view of the emergency illuminating device shown in FIGS. 1 and 3 in accordance with the present invention.

As best seen in FIGS. 3–5, mounting member or plate 28 is generally hook-shaped with a bent portion 92 for connecting to mounting bracket 22 and a planar portion 94 for connecting to auxiliary electrical socket 24. Mounting plate 28 is preferably made of aluminum, but can be made from other appropriate metallic material. Bent portion 92 has a mounting hole 93 extending therethrough for receiving a fastener 99 therein. In particular, bent portion 92 is rigidly coupled to lower coupling end 86 of mounting bracket 22 by fastener 99 extending through mounting hole 93 and coupling aperture 90. Fastener 99 is preferably a rivet, but other types of fasteners can be used such as screws, as well as other fastening methods such as welding.

Mounting plate 28, in its original form, is entirely planar, without bent portion 92. Mounting plate 28 is a conventional mounting attachment for auxiliary electrical socket 24 and integrally attached to auxiliary socket 24 as described below. However, mounting plate 28 is bent from its original shape to be secured to lower coupling end 86 of mounting bracket 22 so that emergency lamp 26 will be inclined relative to central axis A of main socket 14. In other words, bent portion 92 is bent through more than 90° from its original planar position so that auxiliary electrical socket 24 together with emergency lamp 26 are angled away from main lamp 16. This allows for increased spacing between main lamp 16 and emergency lamp 26 than if bent portion 92 was perpendicular to planar portion 94. This increased spacing provides increased dissipation of the heat generated by emergency lamp 26.

Planar portion 94 has a wire access opening (not shown) and a mounting hole 98 extending therethrough. As discussed below, fastening member 30 is fixedly coupled to planar portion 94 of mounting plate 28 such that emergency lamp cover 32 is removably coupled to mounting plate 28 and covers emergency lamp 26.

As best seen in FIGS. 3 and 4, auxiliary electrical socket 24 has a mounting end 100, an open end 102 and a cylindrical body portion 104 extending between mounting end 100 and open end 102. Mounting end 100 has a circular opening (not shown) aligned with the wire access opening in mounting plate 28. Mounting end 100 is attached to mounting plate 28 by a hollow rivet 106 that extends through both the circular opening of mounting end 100 and the wire access opening of mounting plate 28. Hollow rivet 106 establishes a rigid connection between mounting plate 28 and auxiliary electrical socket 24, and has an aperture 107 extending therethrough. Aperture 107 allows electrical wires 108 to pass from auxiliary electrical socket 24, through mounting plate 28, and to housing 12. Auxiliary electrical socket 24, mounting plate 28 and hollow rivet 106 are relatively conventional structures which are known in the art. Thus, these elements will not be discussed in detail herein.

Electrical wires 108 are preferably 120 volt socket wires that electrically couple the electrical contacts 109 positioned within auxiliary electrical socket 24 to the ballast 41 in housing 12 in a conventional manner. Electrical wires 108 are appropriately connected to ballast 41 and other components so that lighting fixture 10 with emergency illuminating device 20 functions as described herein. The wiring of electrical wires 108 is consistent with the wiring diagram schematically illustrated in FIG. 2 when a metal halide lamp is used for main lamp 16.

Auxiliary electrical socket 24 is preferably a bayonet-type socket, which is rated for 500 watts and 125 volts. Cylindrical body portion 104 of auxiliary electrical socket 24 has a longitudinal, central axis B and a width transverse to central axis B. The width of auxiliary electrical socket 24 is preferably substantially less than the width of main socket 14 since lamp 26 is only for back up situations. Cylindrical body portion 104 is hollow to receive emergency lamp 26 therein. Contacts 109 are located within cylindrical portion 104 and are biased by a compression spring (not shown) in a conventional manner. Although auxiliary electrical socket 24 has two identical, electrical contacts 109, only one is illustrated in the figures. Other similar sockets can also be employed. For example, sockets having only one central contact or one central contact and a screwshell can be used.

Also, cylindrical body portion 104 has two substantially identical grooves 110 formed on opposite sides thereof. Since grooves 110 are substantially identical, only one of the grooves 110 is illustrated in the figures and described herein. Each groove 110 has a first portion which extends substantially parallel to central axis B to the mid-section of cylindrical body portion 104 where each groove 110 has a slot 112 extending transverse to central axis B along the perimeter of cylindrical body portion 104. Grooves 110 releasably couple emergency lamp 26 to auxiliary electrical socket 24 as described below.

As best seen in FIGS. 3 and 4, emergency lamp 26 has a connecting end 120 and a bulb portion 122 and is preferably a conventional 100–250 watt quartz incandescent lamp with a double contact, bayonet base. Connecting end 120 has electrical contacts 124 and two cylindrical trunions 126 extending radially, outwardly from opposing sides of connecting end 120. Electrical contacts 124 and electrical contacts 109 of auxiliary electrical socket 24 are configured to mate with each other in a conventional manner. Although emergency lamp 26 has two substantially identical electrical contacts 124, only one is illustrated in the figures.

Trunions 126 are substantially identical; therefore, only one is illustrated in the figures and described herein. Each trunion 126 is a cylindrical extension having a diameter that is smaller than the width of its respective groove 110 of auxiliary electrical socket 24. In other words, trunions 126 are sized so that each can be inserted axially into the first portion of one of the grooves 110 and then twisted into the corresponding slot 112 to maintain emergency lamp 26 securely within auxiliary electrical socket 24.

Bulb portion 122 has a base 128 and a free end 130. Base 128 is coupled to and extends from connecting end 120 to an outermost point 132 on free end 130. Thus, emergency lamp 26 has a length extending from electrical contacts 124 to outermost point 132. Bulb portion 122 is preferably a translucent, quartz envelope that encloses and confines halogen gas around a filament. When in use, surface temperatures of emergency lamp 26 can exceed 600° C.

Bulb portion 122 is connected to auxiliary socket 24 in a conventional manner. Each trunion 126 is aligned within a groove 110 and connecting end 120 is inserted into cylindrical portion 104 of auxiliary socket 24 along central axis B until electrical contacts 108 and 124 engage. At that point, additional force is necessary and directed along central axis B to continue inserting emergency lamp 26 to overcome the spring bias applied to electrical contacts 108 of auxiliary electrical socket 24. Emergency lamp 26 is inserted into auxiliary electrical socket 24 against the spring bias until trunions 126 reach grooves 110. Emergency lamp 26 is then rotated clockwise about central axis B until trunions 126 are fully inserted into slots 112. Emergency lamp 26 can then be released by the installer and the spring bias upon electrical contacts 108 will force each trunions 126 up against the upward most area of its respective slot 112 and securely hold lamp 26 within auxiliary socket 24. Emergency lamp 26 is removed from auxiliary electrical socket 24 by reversing the installation steps.

As best seen in FIGS. 3–4, fastening member 30 has an elastic element 140 and a fastener 142 for releasably coupling emergency lamp cover 32 about emergency lamp 26. Fastener 142 is preferably a screw that is sized for threadedly engaging within mounting hole 98 of mounting plate 28. Although fastener 142 is preferably a screw, other fasteners can be used. For example, a rivet or a bolt can be used if needed and/or desired.

As best seen in FIGS. 3 and 5–7, elastic element or retaining spring 140 is preferably a tension spring with opposite, circular ends 144. Retaining spring 140 is originally a linear, elongated tension spring in its unstressed state with circular coils having an outer diameter of preferably about ¼ inch. Retaining spring 140 has a length sufficient to allow it to snugly wrap around the perimeter of cylindrical body portion 104 of auxiliary socket 24 while having each circular end 144 coupled to fastener 142. Preferably, retaining spring 140 is approximately two inches long between circular ends 144 in its original unstressed configuration. Retaining spring 140 is coupled to fastener 142 by having circular ends 144 wrap around fastener 142. When positioned around auxiliary electrical socket 24 and connected to screw 142, retaining spring 140 is generally circular with a central opening 146 to receive emergency lamp cover 32 therein as described below.

As best seen in FIGS. 3,4 and 8–11, emergency lamp cover 32 has an open end 150 with a flange 152, a closed end 154 with an outermost point 156, and a hollow tubular portion 158 that extends from open end 150 to outermost point 156 of closed end 154. Preferably, cover 32 has a length that is approximately twice as long as the length of emergency lamp 26 to allow for the dissipation of heat produced by emergency lamp 26. Cover 32 is translucent such that the light produced by emergency lamp 26 can pass therethrough in the event that main lamp 16 cuts off. Cover 32 is preferably made from a heat resistant glass, such as borosilicate glass. For example, cover 32 can be a test tube made of heat resistant borosilicate glass, i.e., PYREX and designed from ASTM E982, Type IV requirements. Further, cover 32 preferably has a maximum capacity of 36 milliliters, and a length of approximately 150 millimeters. Tubular portion 158 preferably has an outer diameter of approximately 20 millimeters. Such a test tube is manufactured by Kimble Glass, Inc. under the trademark KIMAX.

Cover 32 is sized such that auxiliary electrical socket 24 and emergency lamp 26, as assembled, can be inserted into cover 32 via open end 150. Thus, tubular portion 158 has an inner diameter greater than the outer dimension of cylindrical portion 104 of auxiliary electrical socket 24. Also, flange 152 has an outer diameter that is greater than the outer diameter of tubular portion 158, but less than the outer diameter of retaining spring 140 in its circular, in use, configuration. However, the outer diameter of flange 152 is greater than the inner diameter of retaining spring 140. Therefore, the size of flange 152 prevents cover 32 from fully receiving auxiliary socket 24 and from being secured by fastening member 30 until retaining spring 140 is stretched over flange 152. That is, retaining spring 140 is stretched over flange 152 to a stretched position around tubular portion 158 so that flange 152 can pass within opening 146 of spring 140 and abut mounting plate 28. Once flange 152 has passed completely through opening 146 of spring 140 and contacts mounting plate 28, cover 32 completely conceals auxiliary electrical socket 24 and emergency lamp 26 and completes assembly of emergency illuminating device 20. In the fully assembled position, flange 152 is positioned between mounting plate 28 and retaining spring 140.

Since retaining spring 140 has to be extended and stretched around flange 152 and is in a stretched orientation around tubular portion 158, retaining spring 140 snugly secures cover 32 in its assembled position. Cover 32 cannot be removed from its assembled position unless retaining spring 140 is manually stretched around flange 152.

In the fully assembled position, cover 32 provides a protective confinement of emergency lamp 26. If bulb portion 122 inadvertently explodes into small, hot glass particles, then those glass particles are confined within cover 32. Retaining spring 140 can then be stretched around flange 152 and cover 32 can be removed from auxiliary electrical socket 24 and emergency lamp 26. The glass particles of exploded bulb portion 122 can then be easily removed from cover 32 by pouring the glass particles out. Emergency lamp 26 can be replaced with a new emergency lamp 26, and cover 32 can then be repositioned around auxiliary socket 24 and emergency lamp 26 and secured to mounting plate 28 by retaining spring 140 as described above. Thus, not only has cover 32 caught the potentially dangerous glass particles and prevented those particles from falling to the area below, but together with retaining spring 140, it has provided an efficient and simple means by which emergency lamp 26 can be replaced and use of the emergency illuminating device continued.

Figure 12:
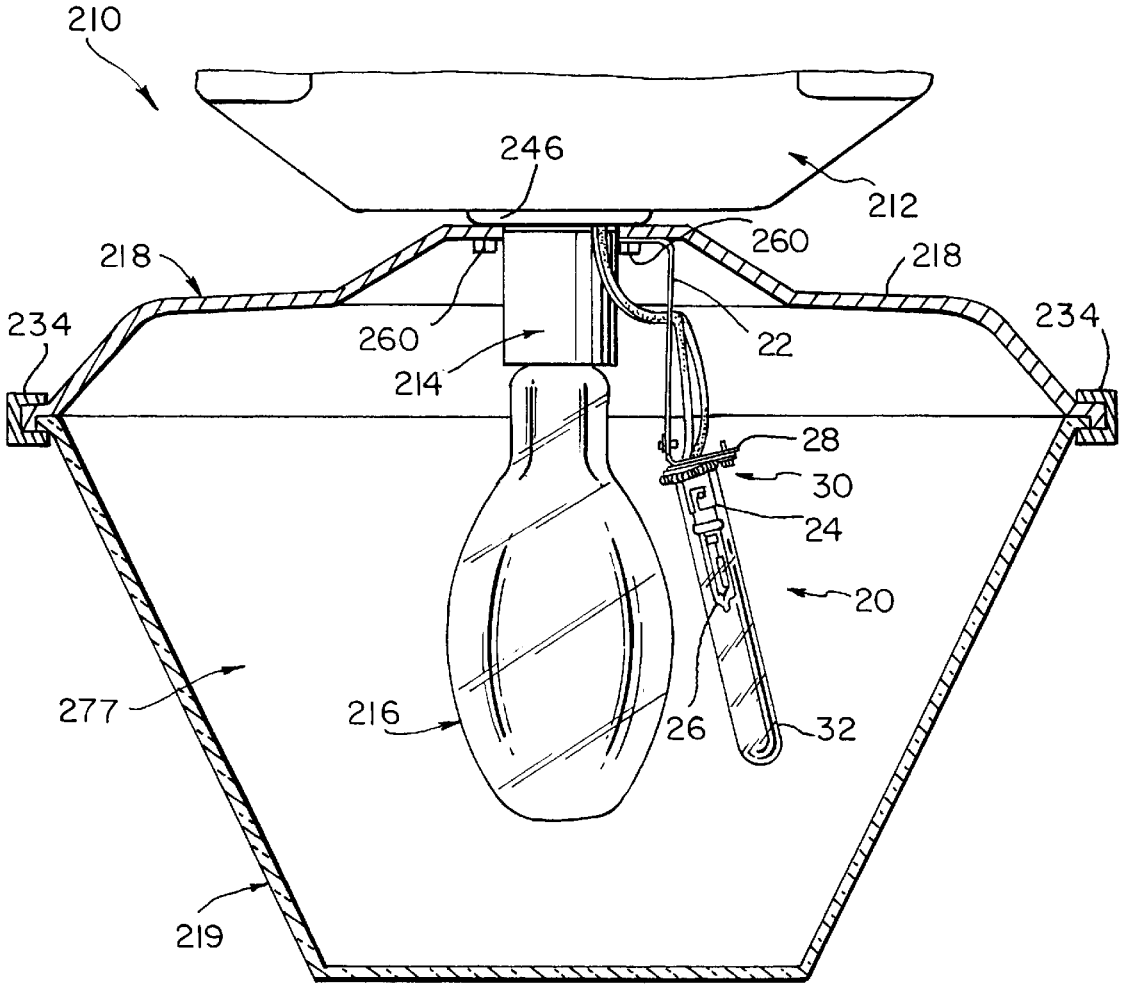
FIG. 12 is a partial side elevational view of a lighting fixture with emergency illuminating device in accordance with a second embodiment of the present invention, illustrating a partial view of the housing and a sectional view of the reflector and the refractor.

Embodiment of FIG. 12

As seen in FIG. 12, lighting fixture 210 is a second embodiment of the present invention. Lighting fixture 210 comprises a ballast housing 212, a main electrical socket 214, a main lamp 216, a reflector 218, a refractor 219 and emergency illuminating device 20 used in the first embodiment. Lighting fixture 210 and emergency illuminating device 20 as shown in FIG. 12 operate in a substantially identical manner as in the first embodiment described above with respect to FIG. 1. Furthermore, emergency illuminating device 20 is identical to emergency illuminating device 20 employed in FIG. 1, and thus, emergency illuminating device 20 will not be discussed further in describing lighting fixture 210.

Lighting fixture 210, absent emergency illuminating device 20, is a conventional HID lighting fixture. Lighting fixture 210 is configured such that main socket 214 is directly mounted to the bottom 246 of ballast housing 212 in a conventional manner. Also, reflector 218 and emergency illuminating device 20 are directly attached to bottom 246 of ballast housing 212 via reflector mounting screws 260.

Reflector 218 is substantially identical to reflector 18, except for its configuration. Reflector 218 is more shallow than reflector 18 so that refractor 219 can be employed, and its perimeter is adapted to receive refractor 219. Refractor 219 is attached at its perimeter to reflector 218 and, like reflector 218, refractor 219 extends 360° around main lamp 216. Refractor 219 is a conventional, translucent refractor that is preferably made from an injection molded plastic such as acrylic or polycarbonate. Refractor 219 is frustoconical in shape and, together with reflector 218, completely encloses main lamp 216 and emergency illuminating device 20 within hollow cavity 277. Refractor 219 is attached by fastening clips 234 in a conventional manner and preferably is designed so that a gasket seal (not shown) can be interposed between reflector 218 and refractor 219 along the extent of the connection between the two elements. It should be understood that the reflector/refractor assembly illustrated and described with respect to FIG. 12 is only one exemplary configuration of the many reflector/refractor configurations that can house emergency illuminating device 20.

While advantageous embodiments have been chosen to illustrate the invention, it will be understood by those skilled in the art from this disclosure that various changes and modifications can be made therein without departing from the scope of the invention as defined in the appended claims.

What is claimed is:

1. A lighting fixture with emergency illuminating device, comprising:

a housing with electrical wiring for connection to a power source;

a first electrical socket coupled to said housing and electrically coupled to said wiring, and having a first central axis and a first width transverse to said first central axis;

a second electrical socket coupled to said housing and electrically coupled to said wiring, and having a second central axis and a second width transverse to said second central axis that is greater than said first width;

a first lamp having a connecting end removably coupled within said first electrical socket and a translucent bulb portion extending from said connecting end;

a second lamp having a connecting end removably coupled within said second electrical socket and a translucent bulb portion extending from said connecting end of said second lamp; and a first translucent cover, with said first lamp located within said first cover and said second lamp located outside said first cover.

2. The lighting fixture according to claim 1 further comprising:

a reflector having a first end coupled to said housing and a second end spaced from said first end, with said first and second lamps positioned within said reflector.

3. The lighting fixture according to claim 2, wherein said second end of said reflector is open.

4. The lighting fixture according to claim 2, wherein said second end of said reflector is closed with a translucent element.

5. The lighting fixture according to claim 1, wherein said first socket is coupled to said housing by a mounting bracket.

6. The lighting fixture according to claim 5, wherein said first cover is removably attached to said mounting bracket by a fastening member.

7. The lighting fixture according to claim 6, wherein said fastening member includes an elastic element.

8. The lighting fixture according to claim 2, wherein said first cover is removably attached to said housing by an elastic element.

9. The lighting fixture according to claim 8, wherein said first cover is a hollow tubular portion that is closed at one end and open at another end, said another end having an outwardly extending flange.

10. An illuminating device, comprising:

an electrical socket having an open end;

a mounting member coupled to said electrical socket;

a lamp having a connecting end removably received within said open end of said electrical socket and a translucent bulb portion extending from said connecting end;

a translucent cover surrounding said bulb portion of said lamp; and a fastening member coupled to said mounting member and having an elastic element, and said light bulb cover being removably attached to said mounting member by said elastic element, said elastic element being coupled to said mounting member by a first fastener, and said elastic element having first and second ends, each of said first and second ends of said elastic element being coupled to said first fastener.

11. The illuminating device according to claim 10, wherein said elastic element is a spring.

12. The illuminating device according to claim 11, wherein said spring is a tension spring.

13. The illuminating device according to claim 10, wherein said cover has a perimeter, and said elastic element extends completely around said perimeter of said cover.

14. The illuminating device according to claim 13, wherein said cover has an outwardly extending flange positioned between said mounting member and said elastic element when said cover is positioned over said bulb.

15. The illuminating device according to claim 14, wherein said elastic element fits snugly around said cover when said cover is positioned around said bulb portion and is adapted to stretch around said flange to allow said cover to be removed from around said bulb portion of said lamp.

16. An illuminating device, comprising:

an electrical socket having an open end;

a mounting member coupled to said electrical socket;

a lamp having a connecting end removably received within said open end of said electrical socket and a translucent bulb portion extending from said connecting end;

a translucent cover surrounding said bulb portion of said lamp; and a fastening member coupled to said mounting member and having an elastic element, and said light bulb cover being removably attached to said mounting member by said elastic element, said cover having a perimeter, and said elastic element extending completely around said perimeter of said cover, said cover having an outwardly extending flange positioned between said mounting member and said elastic element when said cover is positioned over said bulb, said elastic element fitting snugly around said cover when said cover is positioned around said bulb portion and being adapted to stretch around said flange to allow said cover to be removed from around said bulb portion of said lamp, said elastic element being coupled to said mounting member by a first fastener, said elastic element having first and second ends, each of said first and second ends of said elastic element being coupled to said first fastener.

17. An illuminating device, comprising:

an electrical socket having an open end;

a mounting member coupled to said electrical socket;

a lamp having a connecting end removably received within said open end of said electrical socket and a translucent bulb portion extending from said connecting end, said bulb portion having a base coupled to said connecting end and a free end with an outermost point, and said lamp extending a first length from said connecting end to said outermost point;

a translucent cover coupled to said mounting member and surrounding said bulb portion, and having an open end portion with an outwardly extending flange portion positioned adjacent thereto, a closed end portion with an outermost point spaced from said open end portion and a hollow tubular portion extending between said open end portion and said closed end portion, said cover extending a second length from said open end portion to said outermost point and said second length being at least approximately twice as long as said first length; and a fastening member coupled to said mounting member for removably attaching said cover to said socket.

18. The illuminating device according to claim 17, wherein said cover is formed from heat resistant glass.

19. The illuminating device according to claim 17, wherein said flange portion is positioned between said mounting member and said fastening member when said cover is positioned around said bulb portion.

20. The illuminating device according to claim 19, wherein said flange portion is circular and has a first outer diameter, said tubular portion is cylindrical and has a second outer diameter, and said fastening member is circular and has an inner diameter that is less than said first outer diameter and greater than said second outer diameter.

21. The illuminating device according to claim 20, wherein said cover is formed of heat resistant glass.

22. The illuminating device according to claim 21, wherein said heat resistant glass is borosilicate glass.

23. The illuminating device according to claim 22, wherein said second outer diameter is approximately twenty millimeters.

24. The illuminating device according to claim 23, wherein said cover has a length of approximately one hundred and fifty millimeters.

25. The illuminating device according to claim 22, wherein said cover is a test tube with a capacity of approximately 36 milliliters.

* * * * *